US005692256A

United States Patent [19]

Kramer et al.

[11] Patent Number: 5,692,256

[45] Date of Patent: Dec. 2, 1997

[54] MATTRESS FOR A HOSPITAL BED

[75] Inventors: Kenneth L. Kramer, St. Paul; Jason C. Brooke; Eric R. Meyer, both of Greensburg; Gregory W. Branson, Batesville; David J. Ulrich, Sunman, all of Ind.

[73] Assignee: Hill-Rom, Inc., Batesville, Ind.

[21] Appl. No.: 511,546

[22] Filed: Aug. 4, 1995

[51] Int. Cl.[6] ..... A61G 7/053

[52] U.S. Cl. ..... 5/624; 5/613; 5/710; 5/902

[58] Field of Search ..... 5/613, 617, 624, 5/400, 401, 411, 455, 465, 474, 481, 480, 448, 449, 900.5, 902

[56] References Cited

U.S. PATENT DOCUMENTS

| | | | |
|---|---|---|---|
| 583,834 | 7/1897 | Ruth | 5/455 X |
| 4,336,621 | 6/1982 | Schwartz et al. . | |
| 4,369,535 | 1/1983 | Ekkerink | 5/460 X |
| 4,759,088 | 7/1988 | Brown | 5/411 X |
| 4,858,258 | 8/1989 | Mizelle | 5/481 X |
| 5,144,707 | 9/1992 | Callaway et al. . | |
| 5,231,717 | 8/1993 | Scott et al. | 5/400 X |
| 5,245,716 | 9/1993 | Callaway et al. . | |
| 5,303,435 | 4/1994 | Haar et al. | 5/902 X |
| 5,454,126 | 10/1995 | Foster et al. | 5/624 X |

FOREIGN PATENT DOCUMENTS

| | | | |
|---|---|---|---|
| 754052 | 8/1956 | United Kingdom | 5/900.5 |

*Primary Examiner*—Michael F. Trettel

*Attorney, Agent, or Firm*—Barnes & Thornburg

[57] ABSTRACT

A mattress is provided for use with a step deck having an upper deck, and a lower deck coupled to the upper deck by a deck side wall so that the lower deck is spaced apart from the upper deck to define a recess of the step deck. The mattress includes a lower mattress section having a top surface, a bottom surface, and a side wall. The lower mattress section is configured to be located within the recess of the step deck with the bottom surface of the lower mattress section engaging the lower deck, the side wall of the lower mattress section being located adjacent the deck side wall, and the top surface of the lower mattress section being aligned generally in a plane of the upper deck. The mattress also includes an upper mattress section having a top surface, a bottom surface, and a side wall. The top surface of the upper mattress section provides a body support surface, and the bottom surface of the upper mattress section engages the top surface of the lower mattress section and the upper deck.

26 Claims, 6 Drawing Sheets

MATTRESS FOR A HOSPITAL BED

BACKGROUND AND SUMMARY OF THE INVENTION

The present invention relates to a mattress, and particularly to mattresses for hospital beds and other devices upon which patients recline including, for example, stretchers and examination tables. More particularly, the present invention relates to a mattress for hospital beds including beds that can be manipulated to achieve both a conventional bed position having a horizontal sleeping surface and a sitting position having the feet of the person on or adjacent to the floor and the head and back of the person supported above a seat formed by the bed.

Beds and examination tables having mattresses that rest on adjustable articulating decks are known in the art. See, for example, U.S. Pat. Nos. 5,077,843 to Foster L. Dale et al., 5,157,800 to Borders, and 5,129,177 to Celestina et al., all of which are assigned to the assignee of the present invention, and U.S. Pat. Nos. 5,279,010 to Ferrand et al., 4,183,109 to Howell, 4,411,035 to Fenwick, and 3,220,022 to Nelson, as well as German publication No. 716981. Each of these references discloses a bed or an examination table including a mattress having a top surface that articulates to adjust the position of the person on the surface. See also U.S. patent application Ser. No. 08/511,711, filed Aug. 4, 1995, to Weismiller et al. and titled Chair Bed, still pending the specification of which is herein incorporated by reference.

According to the present invention, a mattress for a bed is provided. The mattress includes a generally planar upwardly-facing support surface or sleeping surface for supporting a person and a stepped, downwardly-facing bottom surface. The bottom surface includes a perimetral portion extending downwardly from the support surface a first depth and a central projection extending downwardly from the support surface a second depth which is greater than the first depth.

The illustrative bed on which such a mattress is used includes a base frame, an intermediate frame coupled to the base frame, a weigh frame coupled to the intermediate frame, and an articulating deck coupled to the weigh frame. The mattress of the present invention rests on the articulating deck.

The illustrative articulating deck has longitudinally spaced head, seat, thigh, and foot sections. The head, thigh, and foot sections are movable relative to each other and are movable relative to the seat section which is fixed relative to the weigh frame. The head, thigh, and foot sections are infinitely adjustable to allow the chair bed to attain any desired position within the range of movement of the head, thigh, and foot sections, thus accommodating changes of position of a person on the chair bed.

The mattress is suitable for use with such an articulating deck. The mattress includes a head portion, a seat portion, a thigh portion, and a foot portion. Each named mattress portion is associated respectively with the head, seat, thighs, and feet of the person resting on the sleeping surface of the bed as well as with the underlying head, seat, thigh, and foot sections of the deck.

The illustrative articulating deck carrying the mattress can be a longitudinal step deck that includes upper deck side portions and a central, longitudinally extending recess between the side portions. The recess is defined by a lower deck and side walls connecting the lower deck and the upper portion of the deck. The mattress includes an upwardly facing sleeping surface, a bottom surface, sides connecting the sleeping surface and the bottom surface, and a downwardly extending projection appended to the bottom surface and extending downwardly therefrom. During use, the projection is received by the recess of the step deck. If desired, the projection can nest in the recess and engage at least a portion of the side wall of the deck. The central portion can thus cooperate with the side walls defining the recess to prevent movement of the mattress relative to the bed.

The step deck and a mattress configured for use with the step deck can be used independently of the bed and the articulating deck. For example, a step deck and companion mattress can be provided for a stretcher, gurney, examination table, or any device on which a patient rests. Such a stretcher, for example, can include a frame, a step deck mounted to the frame, the step deck having longitudinal upper side portions engaging the frame, and a mattress having a generally planar sleeping surface and a bottom surface including a projection configured so that the shape of the bottom surface generally conforms to the shape of the step deck. In the same manner, a step deck and associated mattress could be provided for a gurney. Such a gurney would be similar to the illustrative stretcher described above except that the frame would include wheels so that the gurney could be transported by rolling it from place to place.

In preferred embodiments of the mattress, the sleeping surface is generally planar and the projection is centrally located beneath the sleeping surface to form a thick centrally located portion of the mattress. The varied thickness of the mattress provides the mattress with "zones" including a thick body-support zone adjacent to the projection and a thin zone in areas away from the projection. The portion of the mattress adjacent to the upper deck portions form a thin perimetral zone engaging the upper deck portion.

The projection typically includes portions of the area of the bottom surface of the mattress in the head portion, the seat portion, and the thigh portion. The thinner zone typically covers the foot portion of the mattress and a perimetral zone of the mattress along the sides of the thigh, seat, and head portions as well as the head end of the head portion of the mattress. As a result, the thick zone typically encompasses the majority of the portion of the mattress that will be supporting most of the weight of the person on the sleeping surface and the thin zone surrounds the thick zone.

Additionally, the thin perimetral zone of the mattress adjacent to the upper deck portions of the articulating deck cooperates with the upper deck portions to provide "rammed edges" that increase firmness experienced by the person around the edges of the mattress. The mattress cooperates with the step deck to present a generally planar top surface while also providing the thin perimetral zone that results in the rammed edges. This increased firmness is advantageous when the person enters and exits the bed along the sides of the bed.

The mattress may be provided in more than one piece, for example, a first mattress piece could fit into the recess and a second mattress piece could engage the upper deck portion and surround the first mattress piece, or a first mattress piece could fit into the recess and a second mattress piece could cover the first mattress piece and engage the upper deck portion.

Though there are many potential variations of step deck shapes and corresponding mattress shapes and numbers and types of mattress pieces that could be devised, any step deck having an upper deck portion and a recess defined by a bottom deck portion and walls connecting the bottom and the upper deck portions would achieve the desired results.

Likewise, any mattress or combination of mattress pieces that provide a bottom surface generally conforming to the shape of the step deck would achieve the desired results.

It is therefore an object of the present invention to provide a mattress for use on a patient-care bed. The patient care bed has a longitudinally extending patient-support deck provided with longitudinally extending raised upper deck portions extending along its sides. The mattress comprising a longitudinally extending central body portion to be placed on said support deck and lateral portions to be placed upon said upper deck portions. The central body portion has a depth greater than the depth of the lateral portions.

It is another object of the present invention to provide such a mattress having a deflatable foot portion. The mattress comprises a generally planar patient surface and head, seat, thigh, and foot portions. The foot portion is deflatable and has a first length when deflated and a second length when inflated such that the second length is greater than the first length. In addition, the foot portion can be configured to have a first height when deflated and a second height when inflated, the second height being higher than the first height.

In preferred embodiments, the foot portion of the mattress is inflated when the foot section is in the up position. When the foot portion of the mattress is inflated, the sleeping surface of the mattress adjacent to the foot section is generally planar with the sleeping surface adjacent to other sections of the deck. Illustratively, the foot portion of the mattress is automatically deflatable and inflatable and inflates and deflates as the foot section of the deck pivots between the up position and the down position.

Additional objects, features, and advantages of the invention will become apparent to those skilled in the art upon consideration of the following detailed description of the preferred embodiments exemplifying the best mode of carrying out the invention as presently perceived.

BRIEF DESCRIPTION OF THE DRAWINGS

The detailed description particularly refers to the accompanying figures in which:

FIG. 2 is a view similar to FIG. 1 showing the chair bed in the sitting position having a head section of an articulating deck moved upwardly to a back-support position, a thigh section of the deck inclined slightly upwardly, a foot section of the deck moved to a generally vertical downwardly extending down position, a foot portion of the mattress being deflated, and swinging gates moved to an open position with one swinging gate folded next to the chair bed;

DETAILED DESCRIPTION OF THE ILLUSTRATIVE AND PREFERRED EMBODIMENTS

Figure 1:
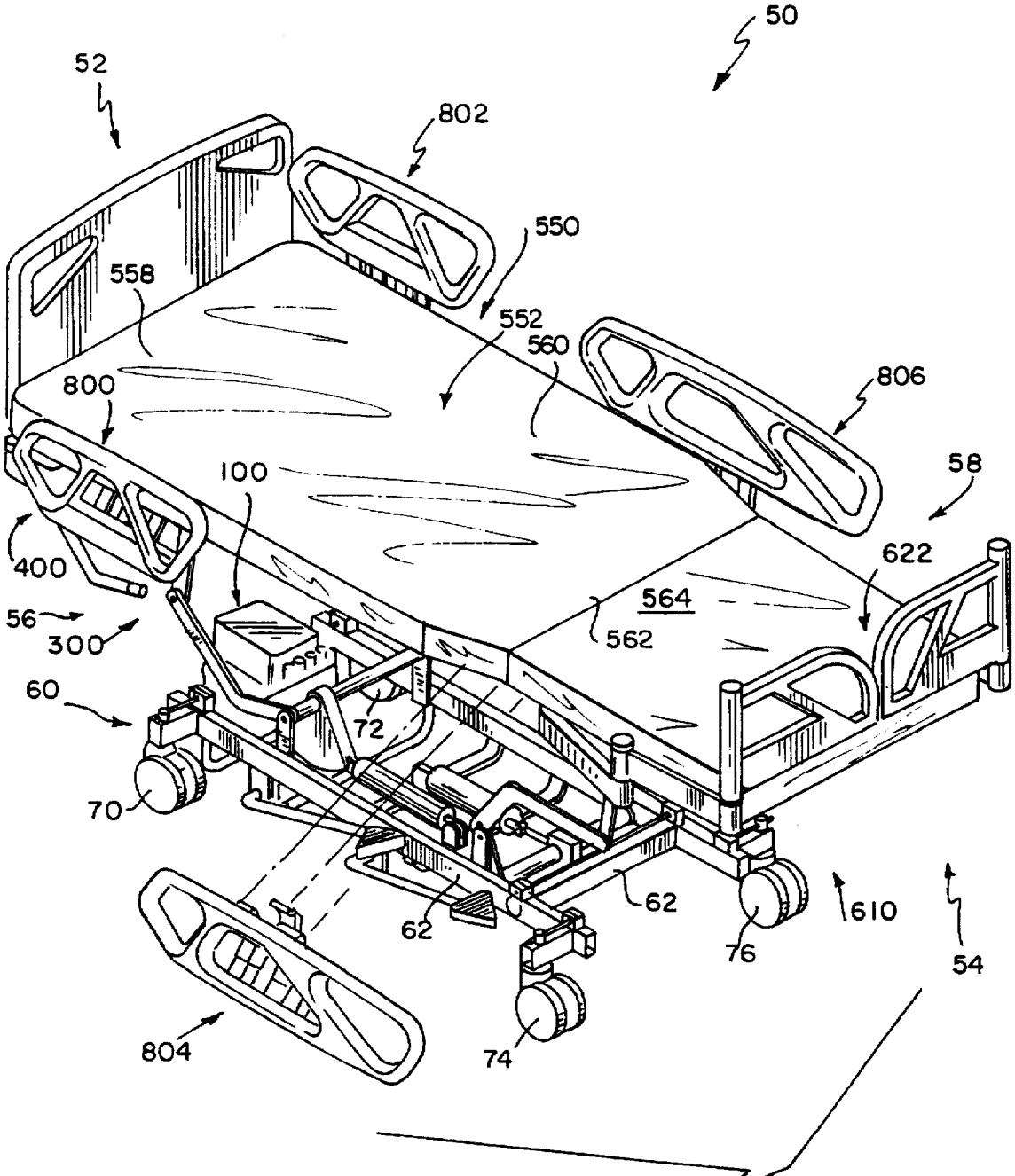
FIG. 1 is a perspective view of a chair bed in accordance with the present invention showing a side rail exploded away from the chair bed, head side rails and foot side rails positioned along longitudinal sides of the deck, and a swinging foot gate in a closed position.

A chair bed 50 in accordance with the present invention having a head end 52, a foot end 54, and sides 56, 58 is illustrated in FIGS. 1 and 2. As used in this description, the phrase "head end 52" will be used to denote the end of any referred-to object that is positioned to lie nearest head end 52 of chair bed 50. Likewise, the phrase "foot end 54" will be used to denote the end of any referred-to object that is positioned to lie nearest foot end 54 of chair bed 50.

Chair bed 50 includes a base module 60 having a base frame 62 connected to an intermediate frame module 300 as shown in FIG. 1. An articulating deck/weigh frame module 400 is coupled to intermediate frame module 300. Side rail assemblies 800, 802, 804, 806 and an extended frame module 610 having a swinging foot gate 622 are coupled to articulating deck/weigh frame module 400. A mattress 550 is carried by articulating deck/weigh frame module 400 and provides a sleeping surface or support surface 552 configured to receive a person (not shown).

Chair bed 50 can be manipulated by a caregiver or by a person (not shown) on sleeping surface 552 using hydraulic system module (not shown) so that mattress 550, an intermediate frame 302 of intermediate frame module 300, and an articulating deck 402 of articulating deck/weigh frame module 400 assume a variety of positions, several of which are shown diagrammatically in FIGS. 3–7.

Articulating deck 402 includes a head section 404, a seat section 406, a thigh section 408, and a foot section 410. Mattress 550 rests on deck 402 and includes a head portion 558, a seat portion 560, a thigh portion 562, and a foot portion 564, each of which generally corresponds to the like-named portions of deck 402, and each of which is generally associated with the head, seat, thighs, and feet of the person on sleeping surface 552. Details of deck 402 and mattress 550 will be explained hereinafter.

Figure 3:
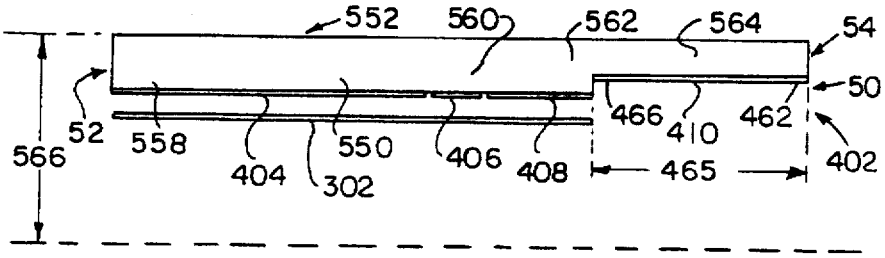
FIG. 3 is a diagrammatic view of the chair bed of FIG. 1 showing the chair bed in a bed position including a mattress having an upwardly-facing sleeping surface held a predetermined first distance above the floor, the deck being in an initial position supporting the sleeping surface in a generally planar configuration, and the foot section being a first length.
Figure 4:
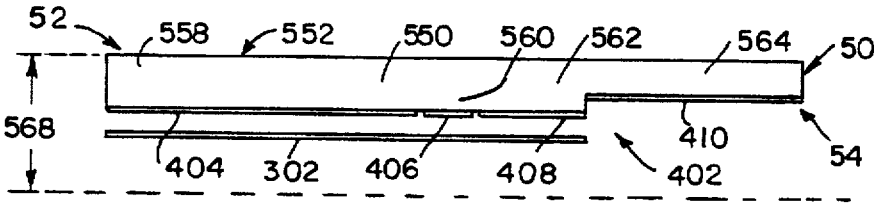
FIG. 4 is a diagrammatic view showing the chair bed in a low position.

Chair bed 50 can assume a bed position having deck 402 configured so that sleeping surface 552 is planar and horizontal, defining an initial position of deck 402 as shown in FIG. 1 and as shown diagrammatically in FIG. 3. In the bed position, sleeping surface 552 is a predetermined first distance 566 above the floor. Chair bed 50 can also be manipulated to assume a low position shown diagrammatically in FIG. 4 having deck 402 in the initial position and having sleeping surface 552 a predetermined second distance 568 above the floor, the second distance 568 being smaller than first distance 566. The foot section 410 of the articulating deck 402 has a first length 465 when the deck 402 is in the initial position.

Figure 5:
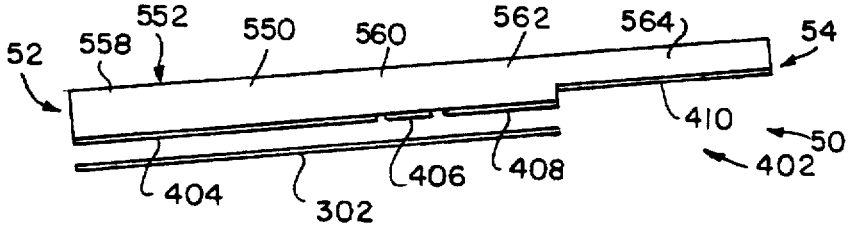
FIG. 5 is a diagrammatic view showing the chair bed in a Trendelenburg position.
Figure 6:
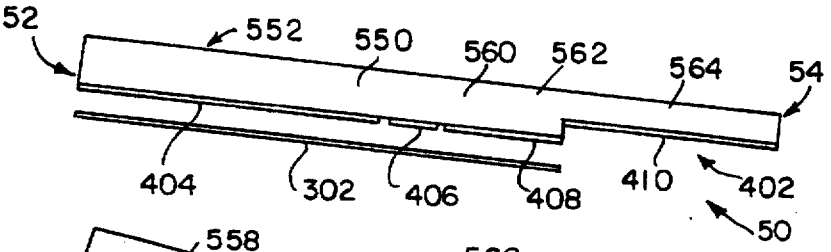
FIG. 6 is a diagrammatic view showing the chair bed in a reverse Trendelenburg position.
Figure 7:
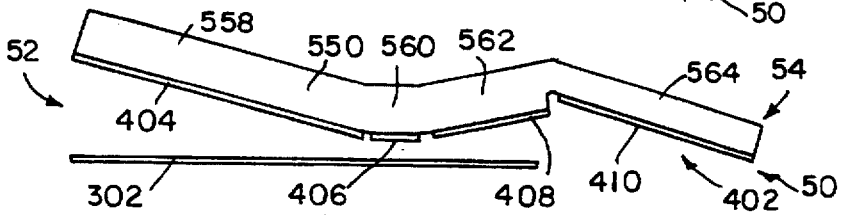
FIG. 7 is a diagrammatic view showing the chair bed in an intermediate position having a head end of a head section of the deck pivoted slightly upward from the initial position of the deck, a seat section positioned to lie in the horizontal plane defined by the seat section in the initial position of the deck, and the foot section being inclined slightly so that the foot end of the foot section lies below the position of the foot section when the deck is in the initial position of the deck.

Chair bed 50 can be moved to a Trendelenburg position shown diagrammatically in FIG. 5 having deck 402 in a planar configuration and tilted so that head end 52 of sleeping surface 552 is positioned to lie closer to the floor than foot end 54 of sleeping surface 552. Chair bed 50 can also achieve a reverse Trendelenburg position shown diagrammatically in FIG. 6 having deck 402 in a planar configuration and tilted so that foot end 54 of sleeping surface 552 is positioned to lie closer to the floor than head end 52 of sleeping surface 552.

Figure 8:
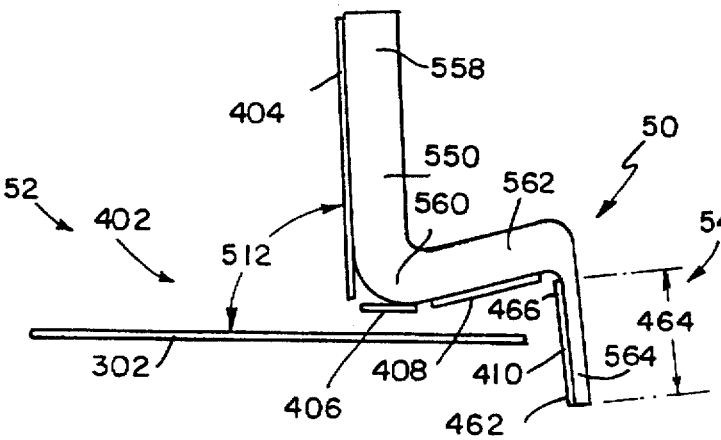
FIG. 8 is a diagrammatic view showing the chair bed in a sitting or chair position with the head end of the head section pivoted upwardly away from the seat section to a back-support position, the seat section lying generally horizontal as in the initial deck position, the thigh section being raised upwardly, the foot section extending downwardly from the thigh section and being a second shorter length, and the portion of the mattress over the foot section being deflated.
Figure 9:
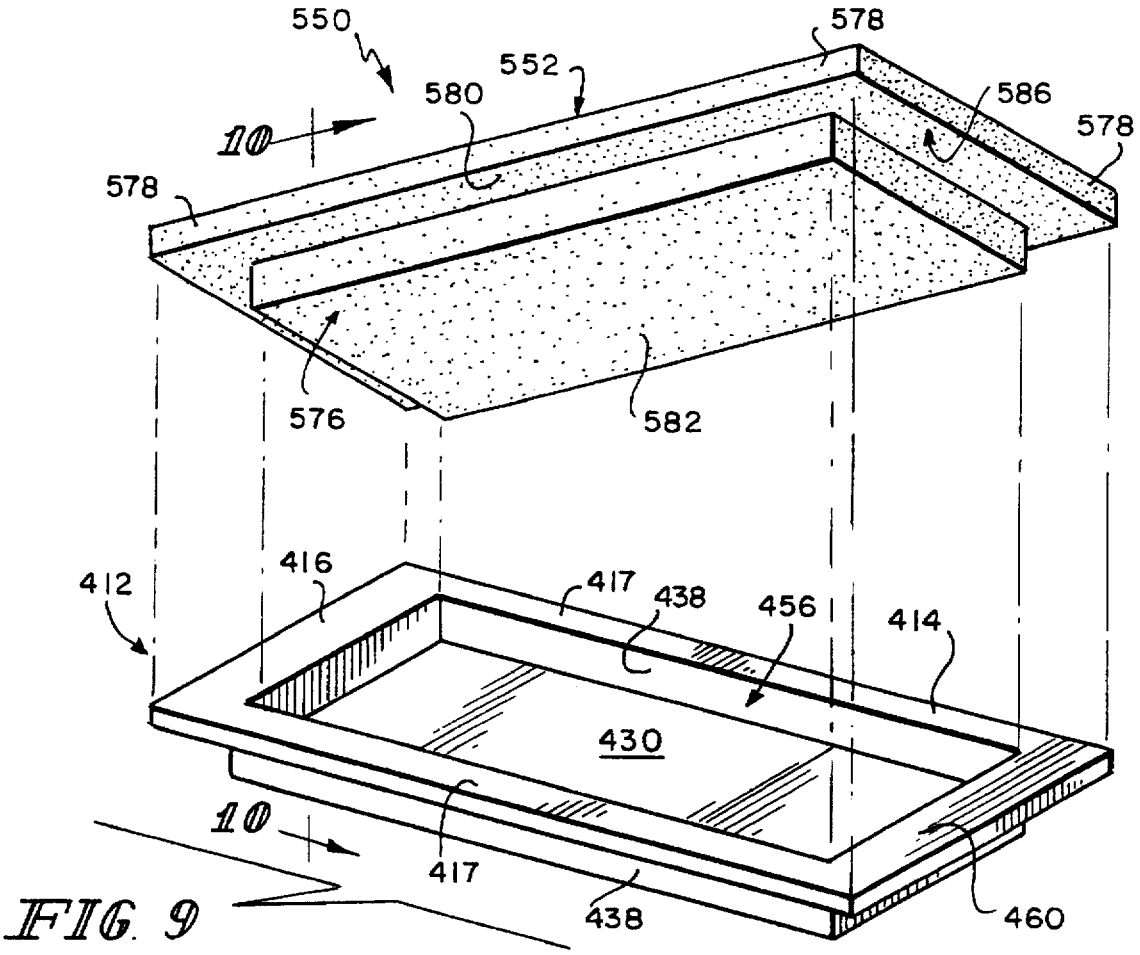
FIG. 9 is a perspective view of a first embodiment of a step deck and a mattress in accordance with the present invention.

As described above, chair bed 50 is convertible to a sitting position shown in FIG. 2 and shown diagrammatically in FIG. 8. In the sitting position, head end 52 of head section 404 of deck 402 is pivoted upwardly away from intermediate frame 302 to a back-support position providing a pivotable backrest so that head section 404 and intermediate frame 302 form an angle 512 generally between 55 and 90 degrees. Seat section 406 of deck 402 is positioned to lie generally horizontally as in the initial position, foot end 54 of thigh section 408 is slightly upwardly inclined, and foot section 410 of deck 402 extends generally vertically downwardly from thigh section 408 and has a length 464 that is shorter than when deck 402 is in the initial position. Foot portion 564 of mattress 550 is inflatable and is in a deflated condition when chair bed 50 is in the sitting position. Foot portion 564 of mattress 550 is thinner and shorter when deflated than when inflated.

Chair bed 50 is capable of assuming positions in which head, thigh, and foot sections 404, 408, 410 of deck 402 are in positions intermediate to those shown in FIGS. 3 and 8. For example, chair bed 50 can assume an intermediate position shown diagrammatically in FIG. 7 having head end 52 of head section 404 of deck 402 pivoted slightly upwardly from the initial position, seat section 406 positioned to lie in the same generally horizontal plane as in the initial position, foot end 54 of thigh section 408 raised slightly upwardly from the initial position, and foot section 410 being inclined so that foot end 54 of foot section 410 lies below head end 52 of foot section 410.

Figure 10:
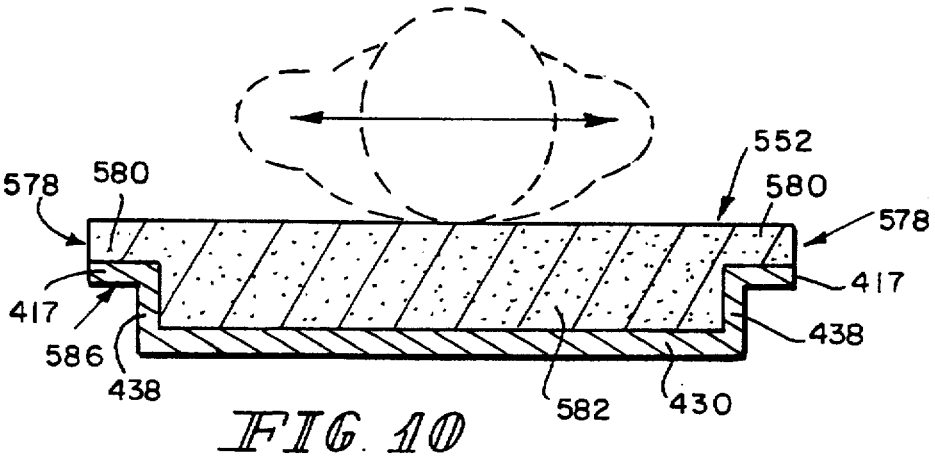
FIG. 10 is a sectional view taken along line 10—10 of FIG. 9 showing the bottom of the step deck beneath the projection.
Figure 11:
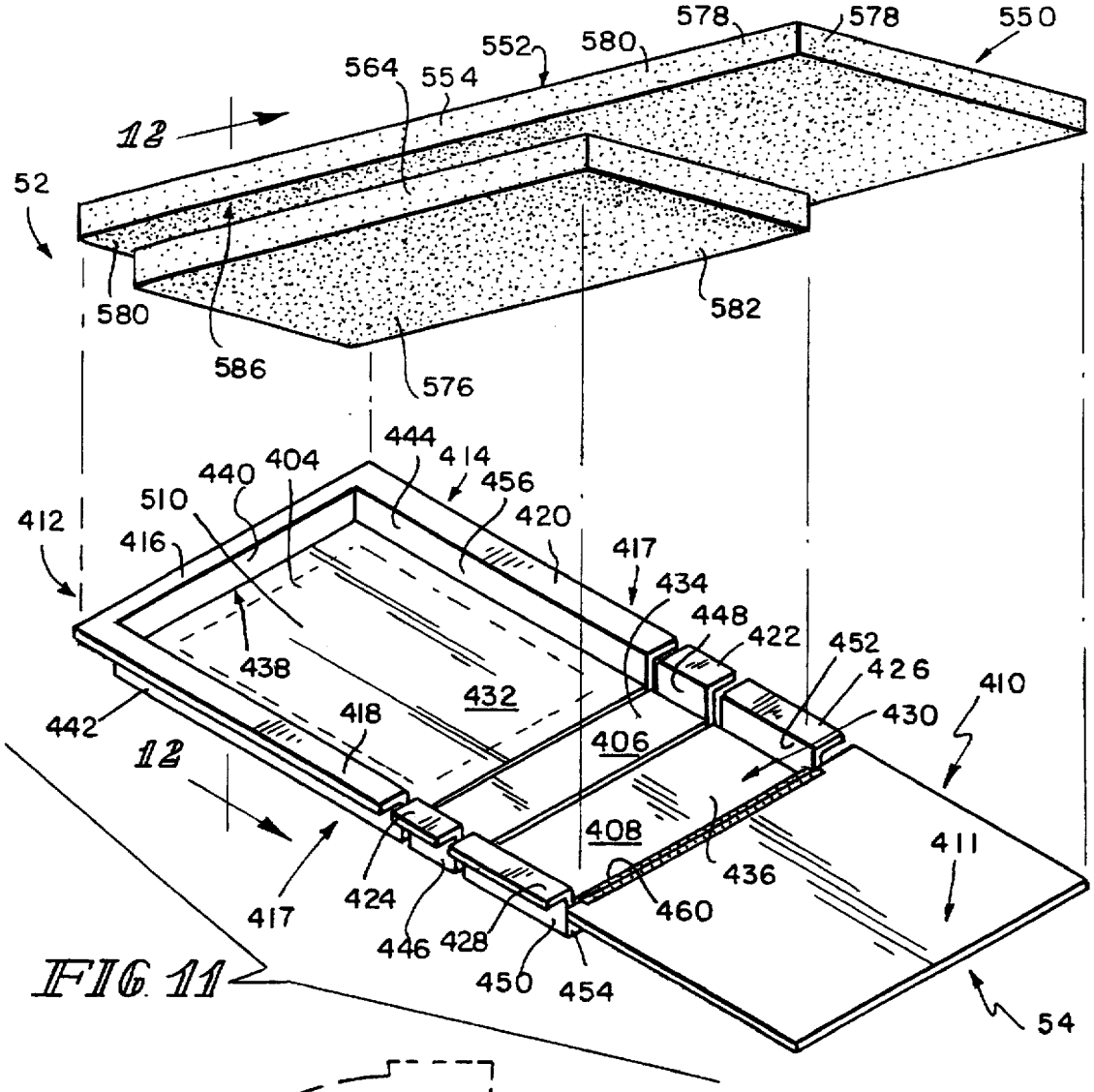
FIG. 11 is an exploded perspective view of a second embodiment of a step deck and the mattress of the chair bed.
Figure 12:
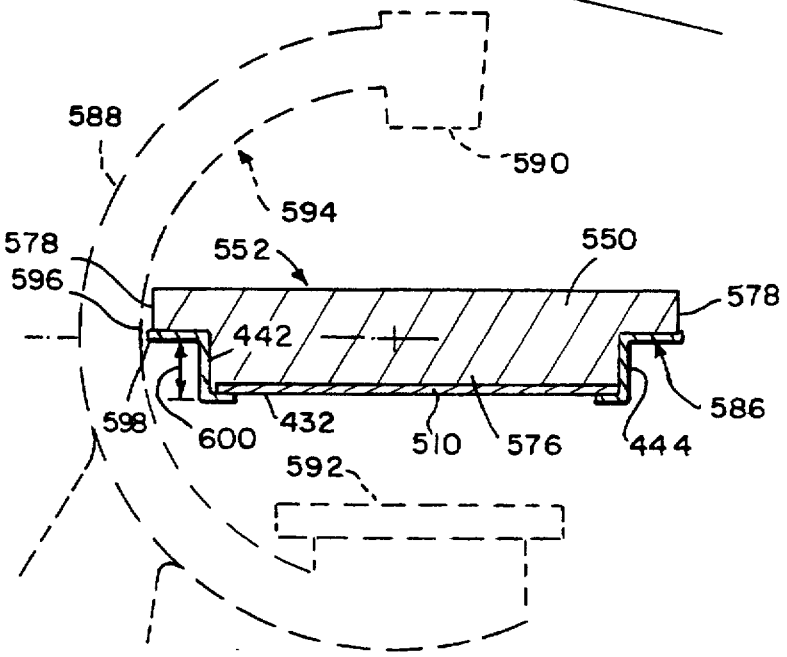
FIG. 12 is a sectional view taken along line 12—12 of FIG. 11 of the step deck and the mattress and showing a C-arm (in phantom) for holding medical equipment such as fluoroscopic equipment.
Figure 13:
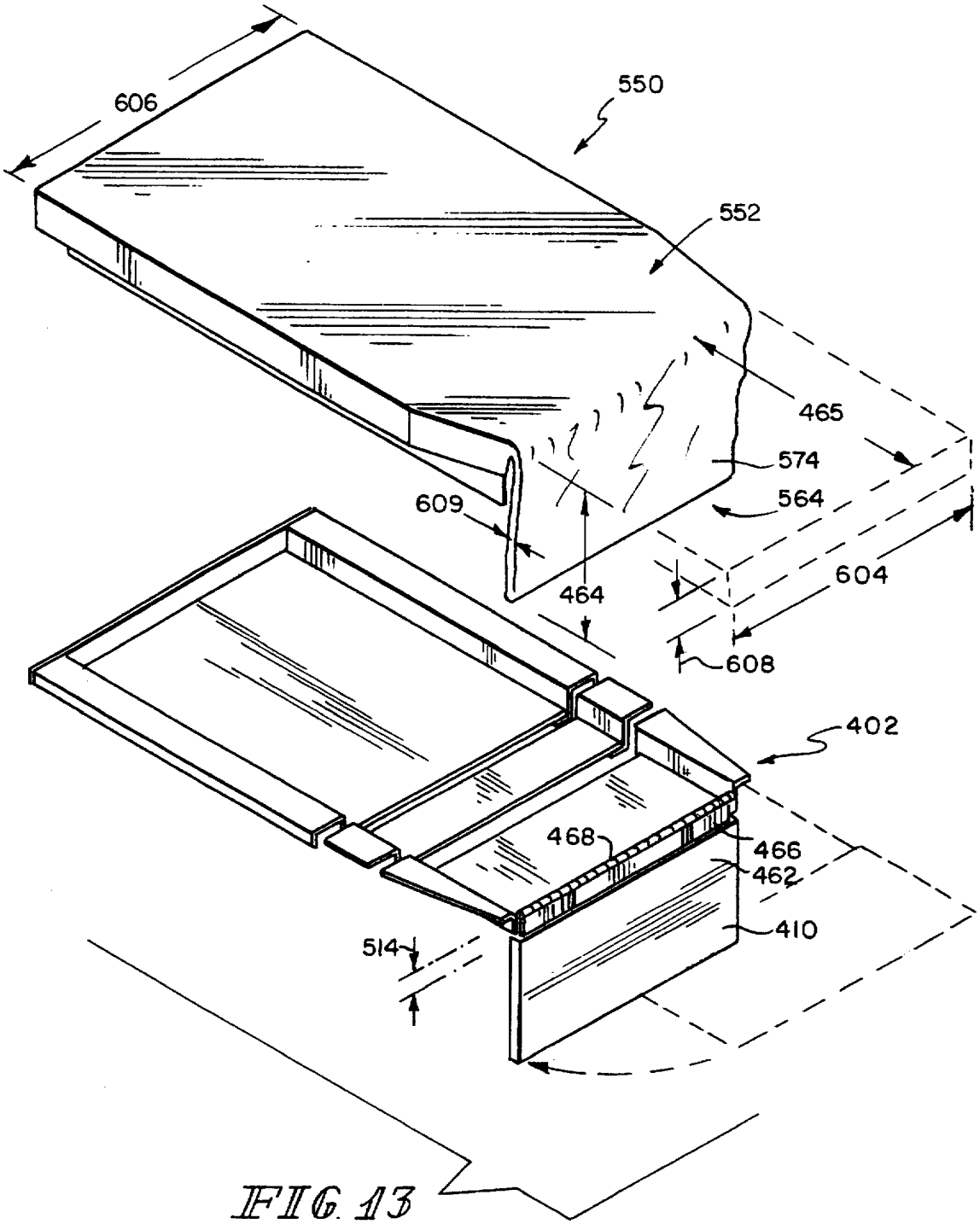
FIG. 13 is an exploded perspective view of a third embodiment of the mattress and the deck showing the foot section of the deck and the foot portion of the mattress in a minimized condition having the foot section of the deck contracted and the foot portion of the mattress contracted longitudinally and deflated so that the foot portion of the mattress is thinner and shorter than when foot portion is inflated.

Additionally, articulating deck 402 of chair bed 50 is configured as a step deck 412 as shown illustratively along with illustrative step mattress 550 in FIGS. 9, 10, and 11–13. The step deck and mattress of FIGS. 11–13 are those illustrated in FIGS. 3–8. Step deck 412 includes an upper deck 414 and a central, longitudinally extending recess 456 defined by a lower deck 430 of step deck 412 and a wall 438 surrounding recess 456 and connecting lower deck 430 to upper deck 414. Upper deck 414 includes longitudinally extending upper deck side portions 417, a head end upper deck end portion 416, and a foot end upper deck end portion 460.

Mattress 550 includes a generally upwardly-facing sleeping surface 552 and a bottom surface 586 that is generally parallel to sleeping surface 552 and that is positioned to lie beneath sleeping surface 552. A perimetral side 578 connects sleeping surface 552 and bottom surface 586. A projection 576 is appended to bottom surface 586 and extends downwardly therefrom. Preferably, projection 576 is spaced-apart from sides 578 of mattress 550 and nests in recess 456. Projection 576 may engage wall 438 of step deck 412 to prevent movement of mattress 550 relative to step deck 412 and to maintain the generally central position of mattress 550 on deck 412.

Preferably, mattress 550 is provided with a thick zone 582 adjacent to recess 456 and projection 576, and a thin zone 580 engaging upper deck 414 as shown in FIG. 10. For example, thick zone 582 can be one and one-half times the thickness of thin zone 580. In one preferred embodiment, the thick zone is approximately 7½ inches (19 cm) thick and the thin zone is 5 inches (12.7 cm) thick. Thick zone 582 is positioned to carry the majority of the weight of a person (shown in phantom) supported on sleeping surface 552 to maximize the comfort of the person. In contrast, perimetral thin zone 580 provides a perimetral portion of mattress 550 that appears to the person on sleeping surface 552 to be firmer than thick zone 582, facilitating entry onto and exit from sleeping surface 552 along sides 578 of mattress 550.

As can be seen, step deck 414 and mattress 550 can be used in many applications requiring a support surface for supporting a person. For example, step deck 414 and mattress 500 can be configured for use as a stretcher to be carried by caregivers and as a gurney having step deck 414 mounted on a frame with wheels for transporting the person supported by the gurney.

Articulating deck 402 is the surface upon which the mattress 550 rests as shown in FIGS. 11–13. Deck 402 is illustratively segmented into head, seat, thigh, and foot sections 404, 406, 408, 410, three of which, head section 404, thigh section 408, and foot section 410, may be rotated to change the angle of inclination of the back, thighs, and lower legs of the person (not shown) with respect to seat section 408. Seat section 406 of deck 402 remains horizontal and the head, thigh, and foot sections 404, 408, 410 of deck 402 can move relative to the seat section 406 and relative to each other, thereby moving the head, thigh, and foot portions 558, 562, 564 of mattress 550 relative to seat portion 560 of mattress 550 and relative to each other.

The head, seat, thigh, and foot sections 404, 406, 408, 410 of articulating deck 402 cooperate to define step deck 412 as shown in FIGS. 11–13. Step deck 412 includes an upper deck 414 having a head end upper deck portion 416 appended to head end 52 of head section 404, side upper deck portions 418, 420, 422, 424,426, 428 appended to sides of the head, seat, and thigh sections 404, 406, 408, and a foot end upper deck portion 460 appended to foot end 54 of weigh frame 506 adjacent to thigh section 408. The upper deck portions 416, 418, 420, 422, 424, 426, 428, 460 and a top surface 411 of foot section 410 are coplanar when articulating deck 402 is in the initial position and cooperate to form upper deck 414 which is generally parallel to weigh frame 506.

Step deck 412 also includes a lower deck 430 having a head slat 432, a seat slat 434, and a thigh slat 436. Head, seat, and thigh slats 432, 434, 436, are coplanar when articulating deck 402 is in the initial position and they cooperate to form lower deck 430 which is generally parallel to weigh frame 506 and to upper deck 414 when articulating deck 402 is in the initial position.

Lower deck 430 is connected to upper deck 414 by a wall 438 including a head end wall 440 connecting head slat 432 to head end upper deck portion 416, side walls 442, 444, 446, 448, 450, 452 connecting head, seat, and thigh slats 432, 434, 436 to side upper deck portions 418, 420, 422, 424,426, 428, and a foot end wall 454 connecting thigh slat 436 to foot end upper deck portion 460 as shown in FIG. 11. Step deck 412, then, comprises upper deck 414 and is formed to include a central, longitudinally extending recess 456 defined by lower deck 430 and by wall 438 connecting lower deck 430 to upper deck 414. In the preferred embodiment, foot section 410 of step deck 412 is displaced from recess 456 and forms part of upper deck 414, as shown in FIGS. 11 and 13.

Mattress 550 is received by articulating deck 402 and includes a projection 576 sized to be received by recess 456 as shown in FIGS. 11 and 12. Consequently, mattress 550 is thinner along sides 580 of mattress 550 where mattress 550 engages upper deck 414 of step deck 412. Conversely, mattress 550 is thicker in portions adjacent to projection 576. Preferably, projection 576 is positioned directly beneath portions of mattress 550 carrying a majority of the weight of the person on sleeping surface 552. The thick portion of mattress 550 including the thickness of mattress 550 between sleeping surface 552 and a bottom surface 586 engaging upper deck 414 plus the thickness of projection 576 provides greater comfort for the person on sleeping surface 552. Mattress 550, then, has a thinner perimetral zone 580 and a thicker body-support zone 582 adjacent to projection 576. Preferably, body support zone is 1½ times the thickness of perimetral zone 580. For example, perimetral zone can be 5 inches (12.7 cm) thick and body-support zone 582 can be 7½ inches (19 cm) thick.

Thinner perimetral zone 580 and upper deck side portions 417 cooperate to define "rammed" edges that provide greater firmness around the edges of sleeping surface 552 as the result of sleeping surface 552 being in closer proximity to upper deck 414. This increased firmness is advantageous when the person enters and exits the bed along the sides of the bed.

Projection 576 includes a side wall 584 that can be configured to engage at least portions of the wall 438 of step deck 412 as shown in FIG. 12, thereby preventing lateral and longitudinal sliding of mattress 550 relative to step deck 412. Also, mattress 550 includes sides 578 connecting sleeping surface 552 and bottom surface 586. Mattress 550 and step deck 412 are configured so that sides 578 of mattress 550 are exposed above deck 402 as shown in FIGS. 11 and 12 providing the caregiver greater and easier access to mattress 550, rather than engaging a portion of a frame or upstanding walls of a deck as is found with conventional mattress and deck systems.

In preferred embodiments, sleeping surface 550 is generally planar and projection 576 is centrally located beneath sleeping surface 550 to form thick body support zone 582 of mattress 550 surrounded by perimetral zone 580 engaging upper deck 414. Mattress 550 may be provided in more than one piece, for example, mattress 550 may comprise a first mattress piece fit into recess 456 and a second mattress piece surrounding and abutting sides of the first mattress piece and engaging upper deck 414, or a first mattress piece could fit into recess 456 and a second mattress piece having a planar bottom surface could fit over the first mattress piece so that the bottom of the second mattress piece engages the first mattress piece and upper deck 414. However, a one-piece mattress 550 including both body-support zone 582 and perimetral zone 580 is preferred.

Additionally, mattress 550 can include an inflatable portion 574 that can assume both an inflated position and a deflated position. Preferably, inflatable portion 574 is positioned to lie in foot portion 564 as shown in FIG. 13 so that inflatable portion 574 can be inflated to serve as sleeping surface 552 when foot section 410 of deck 402 is in the up position and so that inflatable portion 574 can be deflated and inclined downwardly when the foot section 410 is lowered to the down position to provide room for the lower legs of the person when chair bed 50 is in the sitting position. Foot portion 564 is thinner and shorter when deflated than when foot portion 564 is inflated.

Foot portion 564 of mattress 550 and foot section 410 of articulating deck 402 cooperate to minimize the length of the foot of chair bed 50 as shown in FIG. 13. Foot section 410 and foot portion 564 are a first length 465 when foot section 410 is in the up position and a second length 464 when foot section 410 is in the down position, first length 465 being greater than second length 464. Also, foot portion 564 is a first thickness 608 when foot section 410 is in the up position and a second thickness 609 when foot section 410 is in the down position, first thickness 608 being greater than second thickness 609.

In addition, the width 604 of foot portion 564 of mattress 550 is less than the width 606 of head portion 558 of mattress 550, the width 606 of head portion 558 typically being a standard mattress width as shown in FIGS. 11 and 13. This difference between the widths 604, 606 permits a standard fitted sheet (not shown) to be tightly installed onto mattress 550 while remaining loose adjacent to foot portion 564 so that pressure relief can be maintained in the section of foot portion 564 receiving the heels (not shown) of the person (not shown) supported on sleeping surface 552.

Figure 14:
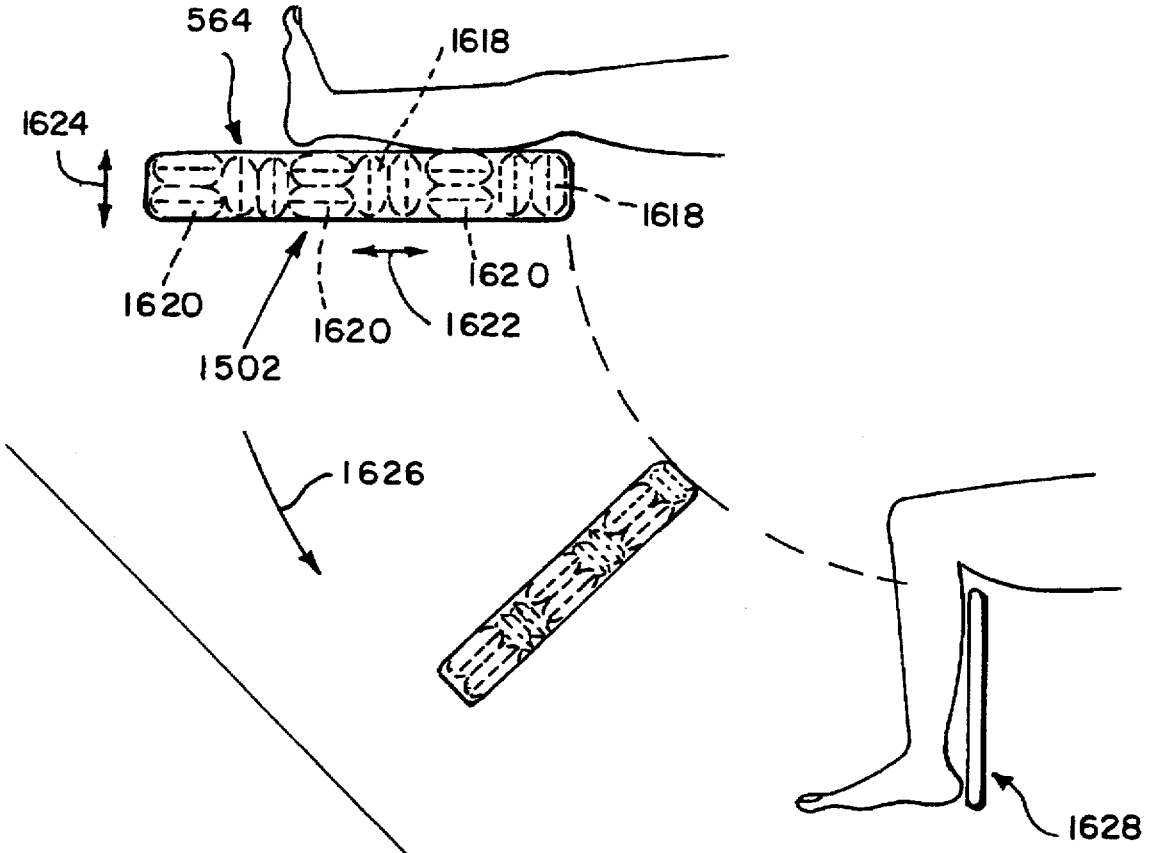
FIG. 14 is a diagrammatical view further illustrating how the surface foot section retracts or shortens and collapses or thins as the bed moves from the bed position to the chair position.

In preferred embodiments, deflatable foot portion 564 includes a first set of air bladders 1618 and a second set of air bladders 1620 alternately positioned with air bladders 1618 as shown in FIG. 14. Air bladders 1618 and 1620 are configured to collapse to a near zero dimension when air is withdrawn from the bladders 1618 and 1620. The first set of bladders 1618 are oriented to collapse in a first direction which is generally parallel to the foot section 410 of deck 402 as illustrated by double headed arrow 1622. The second set of bladders 1620 are configured to collapse in a second direction generally perpendicular to the foot deck section 410 as illustrated by double headed arrow 1624. This orientation of bladders 1618 and 1620 in foot section 1502 advantageously causes the foot section 1502 to contract or shorten and to collapse or thin as the bladders 1618 and 1620 are deflated as foot section 410 moves from the up position to the down position. In the sitting position, foot section 410 and foot portion 564 of mattress 550 move from a generally horizontal position to a generally vertical, downwardly extending position.

Foot portion 564 deflates as it moves from the up position to the down position in the direction of arrow 1626 as shown in FIG. 14. In the up position, foot portion 564 has a length of about 27 inches (68.6 cm) and a thickness of about 5 inches (12.7 cm) when the bladders 1618 and 1620 are fully inflated. When in the down position illustrated at location 1628 in FIG. 14, foot portion 564 is fully deflated and has a length of about 14 inches (35.6 cm) and a thickness of preferably less than one inch (2.54 cm). The length of the surface foot section is preferably reduced by at least 40% and the thickness of the surface foot section is preferably reduced by at least 80% as foot portion 564 moves to the down position. The width of the surface foot portion 564 remains substantially the same in both the up position and the down position.

Although the invention has been described in detail with reference to preferred embodiments, variations and modifications exist within the scope and spirit of the invention as described and defined in the following claims.

We claim:

1. A mattress for use with a step deck having an upper deck, a lower deck coupled to the upper deck by a deck side wall so that the lower deck is spaced apart from the upper deck to define a recess of the step deck, the mattress comprising:

a generally planar upwardly-facing patient support surface, and a stepped downwardly-facing bottom surface including a perimetral portion extending downwardly from the patient support surface a first depth and a central projection extending downwardly from the patient surface a second depth greater than said first depth, a bottom surface of the perimetral portion being configured to rest upon the upper deck, a bottom surface of the central projection being configured to rest upon the lower deck, and a side wall of the central projection being configured to be located adjacent the deck side wall to hold the mattress on the step deck, thereby minimizing a distance that the patient support surface extends above the upper deck.

2. The mattress of claim 1, wherein the mattress includes head, body and foot portion and the projection portion forms a substantial portion of the head and body portions.

3. The mattress of claim 2, wherein a portion of the perimetral portion forms said foot portion.

4. The mattress of claim 1, wherein said projection portion is twice the depth of said perimetral portion.

5. A mattress comprising:

a generally planar upwardly-facing patient support surface, and a stepped downwardly-facing bottom surface including a perimetral portion extending downwardly from the patient support surface a first depth and a central projection extending downwardly from the patient surface a second depth greater than said first depth, the mattress further including head, seat, thigh, and foot portions, at least one of said portions being inflatable.

6. The mattress of claim 5, wherein the projection is positioned to lie beneath the head portion, the seat portion, and the thigh portion, and the projection is spaced-apart from the foot end.

7. The mattress of claim 5, wherein the foot portion is deflatable.

8. The mattress of claim 7, wherein the foot portion is a first length when the foot portion is deflated, the foot portion is a second length when the foot portion is inflated, and the second length is greater than the first length.

9. The mattress of claim 8, wherein the foot portion is a first height when the foot portion is deflated, the foot portion is a second height when the foot portion is inflated, and the second height is greater than the first height.

10. The mattress of claim 7, wherein the foot portion includes two bladders which inflate and deflate in two orthogonal directions to vary the height and length of the foot portion.

11. The mattress of claim 5, wherein the foot portion and the seat portions are independently deflatable.

12. A mattress comprising a generally planar patient surface having head, seat, thigh, and foot portions, and the foot portion including two bladders which inflate and deflate in two orthogonal directions to vary the height and length of the foot portion, the foot portion having a first length when deflated and a second length when inflated, and the second length is greater than the first length.

13. The mattress of claim 12, wherein the foot portion has a first height when the foot portion is deflated, the foot portion has a second height when the foot portion is inflated, and the second height is greater than the first height.

14. The mattress of claim 12, wherein the seat portion is deflatable and the foot portion and the seat portions are independently deflatable.

15. A mattress for use on a patient care bed having a longitudinally extending patient support deck provided with longitudinally extending raised upper deck portions extending along its sides, the mattress comprising a longitudinally extending central body portion to be placed on said support deck and lateral portions to be placed upon said upper deck portions, said central body portion having a depth greater than the depth of said lateral portions and an inflatable and deflatable foot supporting portion extending longitudinally from said central body portion to support the lower legs and feet of a patient.

16. A mattress for use with a step deck having an upper deck, a lower deck coupled to the upper deck by a deck side wall so that the lower deck is spaced apart from the upper deck to define a recess of the step deck, the mattress comprising:

a lower mattress section having a top surface, a bottom surface, and a side wall, the lower mattress section being configured to be located within the recess of the step deck with the bottom surface of the lower mattress section engaging the lower deck, the side wall of the lower mattress section being located adjacent the deck side wall, and the top surface of the lower mattress section being aligned generally in a plane of the upper deck; and an upper mattress section having a top surface, a bottom surface, and a side wall, the top surface of the upper mattress section providing a body support surface, and the bottom surface of the upper mattress section engaging the top surface of the lower mattress section and engaging the upper deck.

17. The mattress of claim 16, wherein the lower mattress section and the upper mattress section are separate sections.

18. The mattress of claim 16, wherein the upper mattress section includes head, body, and foot supporting portions, the lower mattress section extending only below the head and body supporting portions of the upper mattress section.

19. The mattress of claim 18, wherein the foot supporting portion of the upper mattress is deflatable.

20. The mattress of claim 16, wherein the step deck is movable between a bed position and a chair position, the upper mattress section including a foot supporting portion which has a first length when the step deck is in the bed position and a second length when the step deck is in the chair position, the second length being shorter than the first length.

21. The mattress of claim 20, wherein the second length is at least 40% less than the first length.

22. The apparatus of claim 16, wherein the lower mattress section has a thickness which is greater than a thickness of the upper mattress section.

23. A body support surface for use on an articulating deck which is movable between a bed position and a chair position, the support surface comprising a mattress having head, body, and foot supporting portions, the foot supporting portion having a first length when the deck is in the bed position and a second length when the deck is in the chair position, the second length shorter than the first length so that the foot supporting portion of the mattress retracts as the deck moves to the chairposition, the mattress having a first thickness in the head and body supporting portions and a second thickness in the foot supporting portion, the second thickness being less than the first thickness.

24. A body ;support surface for use on an articulating deck which is movable between a bed position and a chair position, the support surface comprising a mattress having head, body, and foot supporting portions, the foot supporting portion having a first length when the deck is in the bed position and a second length when the deck is in the chair position, the second length shorter than the first length so that the foot supporting portion of the mattress retracts as the deck moves to the chair position, the head and body supporting portions of the mattress having a first width and the foot supporting portion has a second width, the second width being less than the first width.

25. A body support surface for use on an articulating deck which is movable between a bed position and a chair position, the support surface comprising a mattress having head, body, and foot supporting portions, the foot supporting portion having a first length when the deck is in the bed position and a second length when the deck is in the chair position, the second length shorter than the first length so that the foot supporting portion of the mattress retracts as the deck moves to the chair position, the second length being at least 40% less than the first length.

26. A body support surface for use on an articulating deck which is movable between a bed position and a chair position, the support surface comprising a mattress having head, body, and foot supporting portions, the foot supporting portion having a first length when the deck is in the bed position and a second length when the deck is in the chair position, the second length shorter than the first length so that the foot supporting portion of the mattress retracts as the deck moves to the chair position, the foot supporting portion including two bladders which inflate and deflate in two orthogonal directions to vary the height and length of the foot supporting portion.

* * * * *